US010043632B2

(12) United States Patent
Fritzler et al.

(10) Patent No.: US 10,043,632 B2
(45) Date of Patent: Aug. 7, 2018

(54) THERMIONIC EMISSION DEVICE, FOCUS HEAD, X-RAY TUBE AND X-RAY RADIATOR

(71) Applicant: SIEMENS HEALTHCARE GMBH, Erlangen (DE)

(72) Inventors: Anja Fritzler, Roettenbach (DE); Peter Geithner, Moehrendorf (DE)

(73) Assignee: Siemens Healthcare GmbH, Erlangen (DE)

( * ) Notice: Subject to any disclaimer, the term of this patent is extended or adjusted under 35 U.S.C. 154(b) by 0 days.

(21) Appl. No.: 15/679,648

(22) Filed: Aug. 17, 2017

(65) Prior Publication Data

US 2018/0053618 A1 Feb. 22, 2018

(30) Foreign Application Priority Data

Aug. 17, 2016 (DE) ..... 10 2016 215 375

(51) Int. Cl.

| | |
|---|---|
| ***H01J 1/22*** | (2006.01) |
| ***H01J 9/04*** | (2006.01) |
| ***H01J 35/06*** | (2006.01) |
| ***H01J 35/10*** | (2006.01) |
| ***H01J 35/14*** | (2006.01) |

(52) U.S. Cl.

CPC ..... *H01J 1/22* (2013.01); *H01J 9/04* (2013.01); *H01J 35/065* (2013.01); *H01J 35/10* (2013.01); *H01J 35/14* (2013.01); *H01J 2235/00* (2013.01)

(58) Field of Classification Search

CPC .. H01J 1/22; H01J 35/065; H01J 35/10; H01J 35/14; H01J 9/04; H01J 2235/00; H01J 2201/28; H01J 2201/19

See application file for complete search history.

(56) References Cited

U.S. PATENT DOCUMENTS

| | | | | |
|---|---|---|---|---|
| 2,108,573 A | | 2/1938 | Alfter | |
| 5,173,931 A | * | 12/1992 | Pond | H01J 35/10 378/127 |
| 8,227,970 B2 | | 7/2012 | Freudenberger | |
| 2010/0166141 A1 | * | 7/2010 | Vermilyea | H01J 35/10 378/19 |

FOREIGN PATENT DOCUMENTS

| | | | |
|---|---|---|---|
| DE | 19828158 | C1 | 11/1999 |
| DE | 102009005454 | B4 | 2/2011 |
| DE | 102012209089 | A1 | 12/2013 |

* cited by examiner

*Primary Examiner* — Joseph L Williams
*Assistant Examiner* — Jose M Diaz
(74) *Attorney, Agent, or Firm* — Laurence Greenberg; Werner Stemer; Ralph Locher

(57) ABSTRACT

A thermionic emission device includes an indirectly heatable main emitter, which is constructed as a flat emitter with a main emission surface, and at least one connectible heat emitter with a heat emission surface. The heat emission surface is disposed at a predefinable distance from the main emission surface. The main emission surface can be asymmetrically heated by the heat emission surface. In the operating state, the main emitter is at a main potential and the heat emitter is at a heating potential which differs from the main potential. An x-ray tube with the thermionic emission device has a longer service life with a consistent image quality.

14 Claims, 3 Drawing Sheets

THERMIONIC EMISSION DEVICE, FOCUS HEAD, X-RAY TUBE AND X-RAY RADIATOR

CROSS-REFERENCE TO RELATED APPLICATION

This application claims the priority, under 35 U.S.C. § 119, of German Patent Application DE 10 2016 215 375.7, filed Aug. 17, 2016; the prior application is herewith incorporated by reference in its entirety.

BACKGROUND OF THE INVENTION

Field of the Invention

The invention relates to a thermionic emission device. The invention also relates to a focus head, an x-ray tube and an x-ray radiator.

A thermionic emission device of that type is known from German Patent DE 10 2009 005 454 B4, corresponding to U.S. Pat. No. 8,227,970, for instance, and in an x-ray tube functions as a cathode. The known thermionic emission device includes an indirectly heated main emitter, which is embodied as a flat emitter with an unstructured main emission surface and with a heat emitter which is embodied as a flat emitter with a structured heat emission surface.

An unstructured emission surface is understood to mean a flat, substantially homogeneous emission surface without slots or similar recesses. An emission surface which is interrupted by slots, for instance, or has a meander-shaped conductor path, is referred to as structured.

In the thermionic emission device known from German Patent DE 10 2009 005 454 B4, corresponding to U.S. Pat. No. 8,227,970, the main emitter and the heat emitter each have at least two connecting lugs, wherein the heat emitter is to some extent nested in the main emitter. The main emission surface and the heat emission surface are aligned substantially in parallel and centrally to one another. The connecting lugs of the main emitter are aligned substantially at right angles to the main emission surface and in the lateral direction do not project beyond the main emission surface. In the known thermionic emission device, the highest possible focal point quality is achieved while using measures which are kept simple in construction, and an unwanted expansion or defocussing of the electron beam is also avoided with high thermal loads.

The electron beam generated in the thermionic emission device strikes a rotary anode at a focal point. Due to the focal point profile of the electron beam, a surface temperature of up to 2,400° C. is produced on the focal path. That surface temperature of the focal path cannot be increased without undesirably shortening the service life of the rotary anode, so that at most only a very minimal increased power can be realized over a very short period of time and a subsequent cooling phase.

SUMMARY OF THE INVENTION

It is accordingly an object of the invention to provide a thermionic emission device, a focus head, an x-ray tube and an x-ray radiator, which overcome the hereinafore-mentioned disadvantages of the heretofore-known devices of this general type and which ensure or guarantee a longer service life of the x-ray tube with a consistent image quality.

With the foregoing and other objects in view there is provided, in accordance with the invention, a thermionic emission device, comprising an indirectly heatable main emitter, which is constructed as a flat emitter with a main emission surface, and at least one connectible heat emitter with a heat emission surface, wherein the heat emission surface is at a predefinable distance from the main emission surface, the main emission surface can be asymmetrically heated by the heat emission surface, and in the operating state, the main emitter is at a main potential and the heat emitter is at a heating potential which differs from the main potential.

The thermionic emission device according to the invention includes a heat emitter, the heat emission surface of which emits electrons and thus heats up the main emitter disposed thereabove. The heat emitter therefore serves as a heat source for the main emitter. The main emitter then emits electrons across its main emission surface, which correspond to the actual tube current and which are responsible for the focal point shape on the anode and thus for the imaging.

With the thermionic emission device according to the invention, the main emission surface of the main emitter is asymmetrically heated by the heat emission surface of the heat emitter. As a result, a correspondingly asymmetric electron emission is achieved in the main emission surface, which focuses on a correspondingly shaped electron beam and forms an asymmetric focal point when it strikes the anode. With a consistent image quality, the electron beam is thus optimized to the lowest possible surface temperature on the anode. Due to the optimized focal point profile of the electrons emitted by the main emitter, the application of heat of the striking electrons is significantly reduced in the anode. The service life of the anode and therefore the service life of the x-ray tube are thus increased correspondingly without reducing the image quality.

The following advantageous embodiments can be realized individually or in combination within the scope of the invention as a function of the application or the field of application of the thermionic emission device.

The asymmetric heating of the main emission surface can be achieved in accordance with an advantageous embodiment in that the heat emission surface is disposed asymmetrically in relation to the main emission surface. According to a further, likewise preferred embodiment, the heat emission surface can be switched asymmetrically in relation to the main emission surface. Both exemplary embodiments represent substantially equivalent variants which can also be realized simultaneously. Within the scope of the invention the heat emission surface of the heat emitter and the main emission surface of the main emitter can therefore be disposed asymmetrically in relation to one another and at the same time the heat emission surface can be switched asymmetrically in relation to the main emission surface.

It is particularly advantageous if the heat emitter includes at least two individually switchable sub-heat emitters with corresponding heat emission surfaces (sub-heat emission surfaces). With an embodiment of this type, the required sub-heat emitter can be easily electrically connected and disconnected, as a result of which a reliable asymmetric heating of the main emission surface is achieved.

Within the scope of the invention, the heat emitter can be realized as a flat emitter or as a coil emitter.

In a particularly advantageous embodiment, an asymmetric heating of the main emission surface is achieved in that a focusing apparatus is disposed between the main emitter and the heat emitter. Due to this focusing apparatus, the electrons emitted by the heat emission surface are focused and asymmetrically directed onto the rear of the main emission surface so that the electrons emitted by the main emission surface form an asymmetric focal point profile. This embodiment thus represents an alternative to the embodiment in which the heat emission surface can be switched asymmetrically.

According to a further advantageous embodiment, an asymmetric heating of the main emission surface is achieved in that the heat emitter can be blocked at least partially by at least one grid. Also with this measure the electrons emitted by the heat emission surface are asymmetrically directed onto the rear of the main emission surface so that the electrons emitted by the main emission surface form a focal point profile. This embodiment thus likewise represents an alternative to the embodiment in which the heat emission surface can be switched asymmetrically.

In order to amplify the temperature gradient for the emission of the imaging electrons, the main emitter is not only electrically contacted on the two narrow sides, but instead advantageously additionally on one of the two longitudinal sides on the focus head.

The thermionic emission device according to the invention or its advantageous embodiments are suitable for problem-free installation into a focus head.

The thermionic emission device or a focus head equipped therewith can be easily installed in an x-ray tube.

The aforedescribed x-ray tubes can be installed in an emitter housing of an x-ray emitter without modifications.

Other features which are considered as characteristic for the invention are set forth in the appended claims.

Although the invention is illustrated and described herein as embodied in a thermionic emission device, a focus head, an x-ray tube and an x-ray radiator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
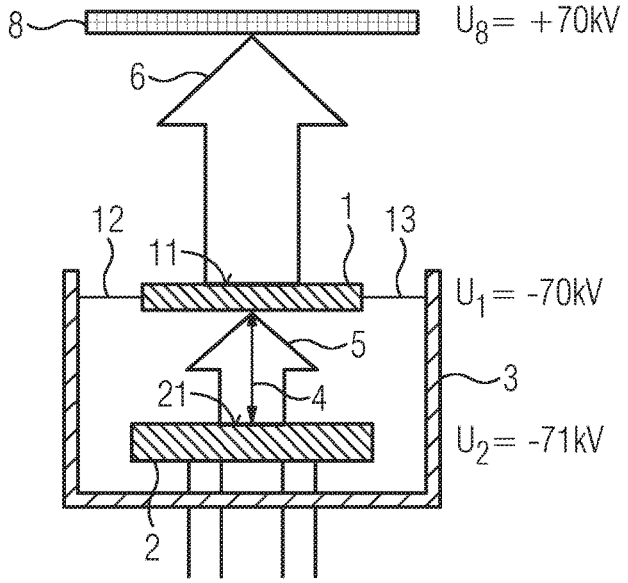
FIG 1 PRIOR ART
FIG. 1 is a diagrammatic, vertical-sectional view of a thermionic emission device according to the prior art.
Figure 2:
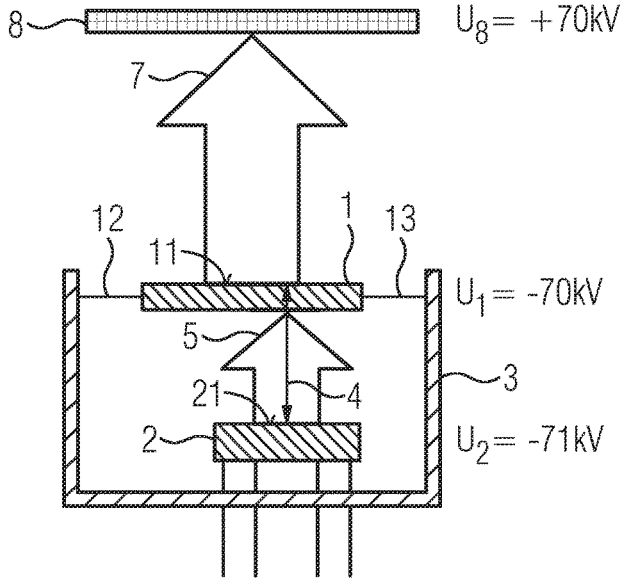
FIG. 2 is a vertical-sectional view of a first embodiment of a thermionic emission device according to the invention.

Referring now in detail to the figures of the drawings, there is seen a thermionic emission device according to the prior art which is shown in FIG. 1 and a thermionic emission device according to a first exemplary embodiment of the invention, to which the invention is not restricted, which is shown in FIG. 2. Each of the thermionic emission devices includes an indirectly heatable main emitter 1 with a main emission surface 11 and a connectible heat emitter 2 with a heat emission surface 21. Both the main emitter 1 as well as the heat emitter 2 are embodied as flat emitters.

The main emitter 1 and the heat emitter 2 are disposed together in a focus head 3. In such cases the main emitter 1 is held mechanically in the focus head 3 and is electrically conductively connected herewith. To this end, two narrow sides of the main emitter 1 are each connected by way of a respective electrical contact 12 or 13 to the focus head 3.

In contrast, the heat emitter 2 is held mechanically in the focus head 3, but is electrically insulated from the focus head 3. The heat emitter 2 can thus be switched independently of the main emitter 1.

Furthermore, the main emitter 1 and the heat emitter 2 are disposed in relation to one another in such a way that the heat emission surface 21 and the main emission surface 11 run substantially parallel to one another at a predefinable distance 4.

To this end, in the operating state, the main emitter 1 is at a main potential $U_1$ and the heat emitter 2 is at a heat potential $U_2$ which differs from the main potential $U_1$.

In the thermionic emission devices shown in FIG. 1 and FIG. 2, the main emitter 1 is at a main potential $U_1=-70$ kV whereas the heat emitter 2 is at a heating potential $U_2=-71$ kV.

In the thermionic emission device shown in FIG. 1, the main emission surface 11 of the heat emitter 1 can be heated up by the heat emission surface 21 of the heat emitter 2. Since the heat emission surface 21 and the main emission surface 11 are disposed in parallel and at right angles to one another, the heat emission surface 21 is disposed symmetrically in relation to the main emission surface 11.

In the operating state, the heating potential $U_2$ is more negative than the main potential $U_1$ ($U_2<U_1$). During normal operation electrons which are focused by the focus head 3 on an electron beam 5 are thus emitted by the heat emitter 2. The electron beam 5 strikes and heats up the main emitter 1. The main emitter 1 is heated up symmetrically by the electron beam 5. The main emitter 1 emits electrons from the main emission surface 11. Those electrons are focused on an electron beam 6 and are accelerated in the direction of an anode 8. When the electron beam 6 strikes, x-ray radiation is generated in a known manner in the material of the anode 8.

As illustrated in FIG. 2 in a first exemplary embodiment, the main emission surface 11 of the main emitter 1 can be heated asymmetrically in accordance with the invention by the heat emission surface 21 of the heat emitter 2. The heat emission surface 21 is therefore not symmetrical or congruent with the main emission surface 11.

Due to the asymmetric heating of the main emitter 1, a corresponding temperature gradient forms, which results in a corresponding asymmetrical electron emission in the main emission surface 11. This asymmetric electron emission is focused on a correspondingly shaped electron beam 7 and when striking the anode 8, which is preferably embodied as a rotary anode, forms a focal point with an asymmetric profile or a focal path with an asymmetric focal path profile. With a consistent image quality, the electron beam 7 is thus optimized with respect to the lowest possible surface temperature on the anode 8. Due to the optimized focal point profile of the electrons emitted by the main emitter 1, the application of heat of the striking electrons is significantly reduced in the anode 8. The service life of the anode 8 and thus the service life of the x-ray tubes are thus increased correspondingly without reducing the image quality.

Figure 3:
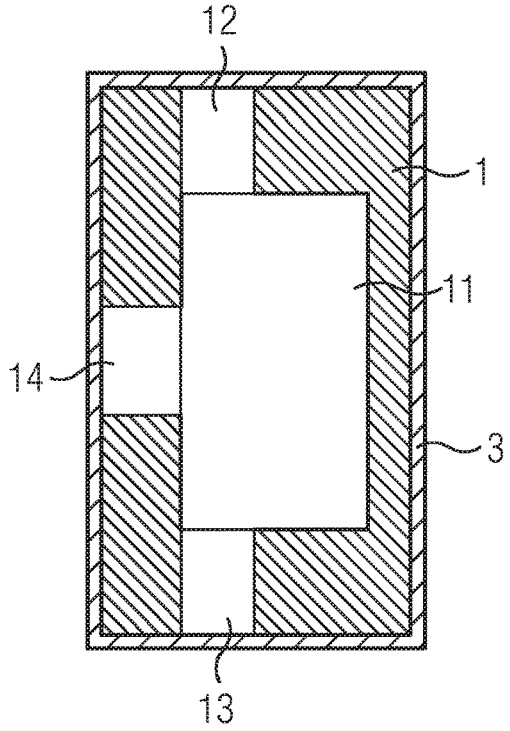
FIG. 3 is a cross-sectional view from above onto an emitter according to a second embodiment of a thermionic emission device according to the invention.

The temperature gradient produced on the main emitter 1, which results from the asymmetric heating by the heat emitter 2, can be amplified in that the main emitter 1 not only has an electrical contact 12 or 13 with the focus head 3 on the two narrow sides in each case, but instead is advantageously additionally in contact by way of an electrical contact 14 with the focus head 3 on one of the two longitudinal sides. FIG. 3 shows an exemplary embodiment of this type.

The heat emitter 2 can, as shown in FIG. 2 and FIG. 3, be embodied as a flat emitter. Within the scope of the invention, it is however also possible to embody the heat emitter 2 as a coil emitter, as shown in FIG. 4 to FIG. 6.

Figure 4:
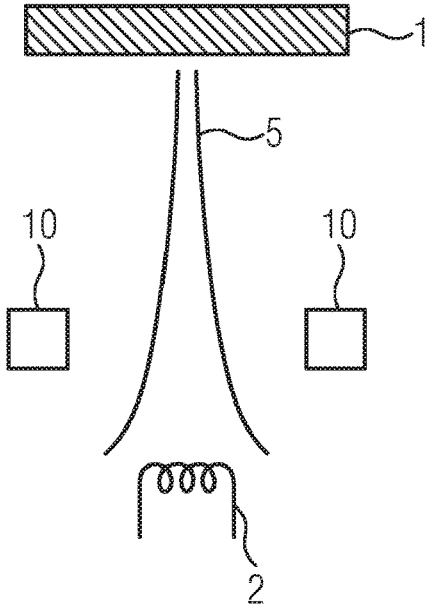
FIG. 4 is a vertical-sectional view of a third embodiment of a thermionic emission device according to the invention.
Figure 5:
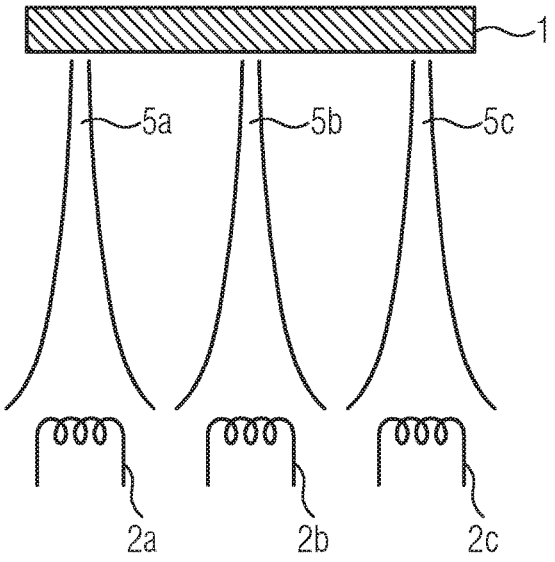
FIG. 5 is a vertical-sectional view of a fourth embodiment of a thermionic emission device according to the invention.
Figure 6:
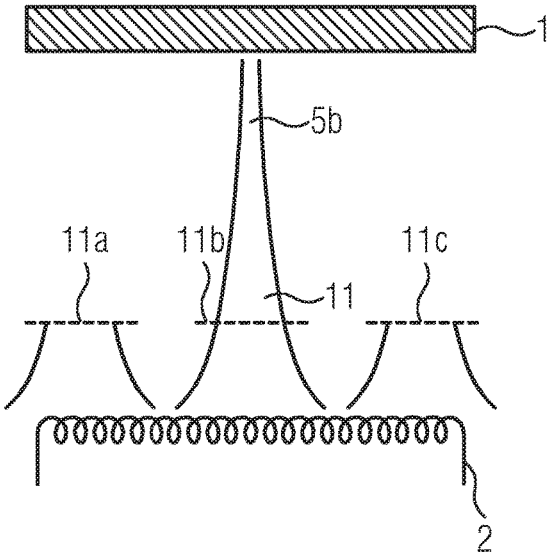
FIG. 6 is a vertical-sectional view of a fifth embodiment of a thermionic emission device according to the invention.

In the embodiments of the thermionic emission device shown in FIG. 4 to FIG. 6, the focus head 3 is not shown for reasons of clarity in each case.

The exemplary embodiment shown in FIG. 4 includes a heat emitter 2 with a single coil emitter. Prior to striking the main emitter 1 the electrons emitted by the coil emitter 2 are focused on an electron beam 5 by an electromagnetic focusing device 10 and at a desired point are asymmetrically deflected onto the rear of the main emitter 1.

In the embodiment shown in FIG. 5, the heat emitter 2 is formed for instance of three individual coil emitters 2*a*, 2*b* and 2*c*, which can be switched independently of one another. The electrons emitted by each of the coil emitters 2*a*, 2*b* and 2*c* (sub-heat emitter) are in turn focused on a respective electron beam 5*a*, 5*b* or 5*c* prior to striking the main emitter 1. Due to an optional connection or disconnection of the individual coil emitters 2*a*, 2*b* and 2*c*, the main emitter 1 can be heated asymmetrically at defined points.

In the embodiment shown in FIG. 6, the heat emitter 2 is in turn constructed as a coil emitter. A controllable grid 11 is disposed between the coil emitter 2 and the main emitter 1. The controllable grid 11 has three grid areas 11*a*, 11*b* and 11*c* and is selectively blockable by way of a grid voltage. In the exemplary embodiment shown, the electrons leave the grid 11 by way of the middle grid area 11*b* and strike the main emitter 1 as a focused electron beam 5*b*. By optionally blocking the grid areas 11*a*, 11*b* and 11*c*, the main emitter 1 can be asymmetrically heated at a defined point.

In the embodiments shown in FIGS. 4 to 6, the emitters 2 (FIG. 4, FIG. 6) or the sub-emitters 2*a*, 2*b*, 2*c* (FIG. 5) are constructed as coil emitters. Within the scope of the invention it is, however, also possible to construct the emitters 2 or the sub-emitters 2*a*, 2*b*, 2*x* as flat emitters.

As is apparent from the description of the five embodiments of the thermionic emission device according to the invention which are shown by way of example, the thermionic emission device and its advantageous embodiments are suitable for a problem-free installation in a focus head 3.

The thermionic emission device or a focus head 3 equipped therewith can be easily installed in an x-ray tube. An x-ray tube of this type can be installed in an emitter housing of an x-ray emitter without modifications.

Although the invention has been illustrated and described in detail on the basis of the preferred exemplary embodiments, the invention is not limited by the disclosed examples and other variants can be derived therefrom by the person skilled in the art without departing from the scope of protection of the invention.

The invention claimed is:

1. A thermionic emission device, comprising:

an indirectly heatable main emitter being constructed as a flat emitter having a main emission surface; and at least one connectible heat emitter having a heat emission surface;

said heat emission surface being disposed at a predefinable distance from said main emission surface;

said heat emission surface being configured to asymmetrically heat said main emission surface;

in an operating state, said main emitter being at a main potential and said heat emitter being at a heating potential differing from said main potential.

2. The thermionic emission device according to claim 1, wherein said heat emission surface is disposed asymmetrically relative to said main emission surface.

3. The thermionic emission device according to claim 1, wherein said heat emission surface is configured to be switched asymmetrically relative to said main emission surface.

4. The thermionic emission device according to claim 1, wherein said heat emitter includes at least two individually switchable sub-heat emitters.

5. The thermionic emission device according to claim 1, wherein said heat emitter is a flat emitter.

6. The thermionic emission device according to claim 1, wherein said heat emitter is a coil emitter.

7. The thermionic emission device according to claim 1, which further comprises a focusing apparatus disposed between said main emitter and said heat emitter.

8. The thermionic emission device according to claim 1, which further comprises at least one grid for at least partially blocking said heat emitter.

9. The thermionic emission device according to claim 1, wherein said main emitter has two longitudinal sides, and an electrical contact is disposed at one of said two longitudinal sides.

10. A focus head, comprising a thermionic emission device according to claim 1.

11. An x-ray tube, comprising an anode and a thermionic emission device according to claim 1.

12. An x-ray tube, comprising an anode and a focus head including a thermionic emission device according to claim 1.

13. The x-ray tube according to claim 10, wherein said anode is a rotary anode.

14. An x-ray radiator, comprising:

a radiator housing; and an x-ray tube disposed in said radiator housing, said x-ray tube including an anode and a thermionic emission device according to claim 1.

* * * * *